US005549071A

United States Patent [19]

Pigeon et al.

[11] Patent Number: 5,549,071

[45] Date of Patent: Aug. 27, 1996

[54] SKI TOW BOAT WITH WAKE CONTROL DEVICE AND METHOD FOR OPERATION

[75] Inventors: Charles Pigeon, Abilene, Tex.; Stephen Jones, Rancho Cordova, Calif.

[73] Assignee: Tige Boats, Abilene, Tex.

[21] Appl. No.: 498,023

[22] Filed: Jul. 3, 1995

[51] Int. Cl.[6] ..... B63B 1/22

[52] U.S. Cl. ..... 114/286

[58] Field of Search ..... 114/284–287, 126

[56] References Cited

U.S. PATENT DOCUMENTS

| | | | |
|---|---|---|---|
| 2,265,206 | 12/1941 | Stampfl . | |
| 3,046,928 | 7/1962 | Sherrill . | |
| 3,404,651 | 10/1968 | Jensen . | |
| 3,577,948 | 5/1971 | Frey . | |
| 3,695,204 | 10/1972 | Bennett | 114/286 |
| 3,698,343 | 10/1972 | Boome | 114/285 |
| 4,519,336 | 5/1985 | Mason | 114/286 |
| 4,896,622 | 1/1990 | Thomas | 114/285 |
| 5,058,520 | 10/1991 | Fahrney | 114/285 |

FOREIGN PATENT DOCUMENTS

| | | | |
|---|---|---|---|
| 282193 | 12/1986 | Japan | 114/286 |

*Primary Examiner*—Jesus D. Sotelo

*Attorney, Agent, or Firm*—Flehr, Hohbach, Test, Albritton & Herbert

[57] ABSTRACT

An inboard power boat for towing water skiers is disclosed which incorporates a wake control device. The boat has a hull configuration in which the stern portion has a flat or semi-flat bottom. The wake control device is comprised of a single flat plate which is pivotally mounted to the stern along the longitudinal axis of the hull. An hydraulic control circuit is provided for pivoting the plate about a transverse axis so that its trailing end moves between raised and lowered positions. The trailing end is moved to a selected position to selectively control the size of the wake as the trailing edge projects to a lesser or greater extent into the stream of water which moves under the hull as the boat moves forward.

7 Claims, 3 Drawing Sheets

SKI TOW BOAT WITH WAKE CONTROL DEVICE AND METHOD FOR OPERATION

BACKGROUND OF THE INVENTION

1. Field of the Invention

This invention relates in general to boats for use in the sport of water skiing. More particularly, the invention relates to apparatus and method of operation for controlling the wake in water behind ski tow boats of the type which include an inboard power plant and a flat bottom hull.

2. Description of the Related Art

In the sport of water skiing, the water skiers are pulled through the water by boats which create wakes. Family or novice skiers desire a flat wake that they can cross as they are pulled through the water at relatively slow speeds. More athletic or competitive skiers desire larger wakes which they can cross while performing acrobatics. The relatively recent introduction of wake boards and knee boards have introduced styles of water skiing where the enthusiasts desire large wakes which can be used to perform jumps into the air.

Various types of power boats have heretofore been used for towing water skiers. These include trailable boats which typically are 25' and under in length and which are powered either by outboard motors or by inboard engines with propeller drive units. The majority of these types of boats have a hull with a deep V-shaped cross-section. In this type of power boat, it is desirable to quickly get the front end of the hull out of the water at a higher angle of attack as the boat accelerates to cut down on drag and allow the boat to go much faster. This causes the stern of the boat to sit down into the water so that it effectively digs a trench along the path that it makes through the water, which in turn produces bigger wakes.

Conventional power boats have been fitted with adjustable trim tabs on port and starboard sides of the stern transom, as for example the boat shown in FIG. 1. In the boat of FIG. 1, a pair of adjustable trim tabs 10 and 12 are mounted on the bottom of the stern transom in a manner described in U.S. Pat. No. 5,058,520. Hydraulic actuators 14 and 16 are mounted between the transom and tabs to conjointly pivot the tabs up or down under control of the boat operator. When the tabs are conjointly moved down, they help get the boat up on plane faster. The tabs can also be moved independently to correct any left-to-right lean or roll of the boat about its longitudinal axis. Appropriate adjustment of the trim tabs is made for trimming the boat for reasons such as better fuel economy.

Ski tow boats known as tournament boats have become popular for competitive skiing. Tournament boats are inboards which have relatively low top speeds of up to only about 50 mph. The lower speeds are due to the fact that the hulls run "wet", meaning that they have a relatively high drag. The hulls do not have a deep V-shaped hull design as in conventional power ski tow boats. Instead they have hulls with a cross-section which has a V-shape at the bow that merges amidship into a flat or semi-flat bottom at the stern. Such a flat or semi-flat stern bottom design allows the hulls to run with a greater surface area along the top of the water which produces the higher drag. The hulls of tournament boats when run at speed do not lift with a high angle of attack characteristic of deep V-shaped hull boats, and thus produce smaller wakes. Prior art tournament boats have not been capable of selectively changing the size of the wake so the boat can be used by a range of skiers having different skills and sporting tastes.

The need has been recognized for a ski tow boat which obviates the foregoing and other limitations and disadvantages of prior art ski tow boats. Despite the various ski tow boats in the prior art, there has heretofore not been provided a suitable and attractive solution to these problems.

OBJECTS AND SUMMARY OF THE INVENTION

It is a general object of the present invention to provide a new and improved ski tow boat which facilitates controlling the size of the wake produced when the boat moves through the water.

Another object is to provide a wake control device for use with a tournament-type ski tow boat in which the size of the wake can be selectively controlled.

Another object is to provide a tournament ski tow boat of the type described which incorporates a device that selectively controls the wake produced by the boat.

Another object is to provide a method of controlling the wake made in the water by an inboard boat of the type which includes a flat bottom hull.

The invention in summary provides a wake control device used with a tournament-type ski tow boat, and method of operation, for controlling the wake made in the water by the boat. The control device is comprised of a plate having forward and trailing ends together with means for mounting the forward end on the stern of the boat. The trailing end of the plate is controlled for movement between a raised position and a lowered position. In the lowered position, the trailing end projects downwardly and rearwardly into the water. The control includes means for selectively varying the vertical stroke of the plate to thereby selectively control the size of the wake.

The foregoing and additional objects and features of the invention will become apparent from the following description in which the preferred embodiment has been set forth in detail in conjunction with the accompanying drawings.

DESCRIPTION OF THE PREFERRED EMBODIMENTS

Figure 1:
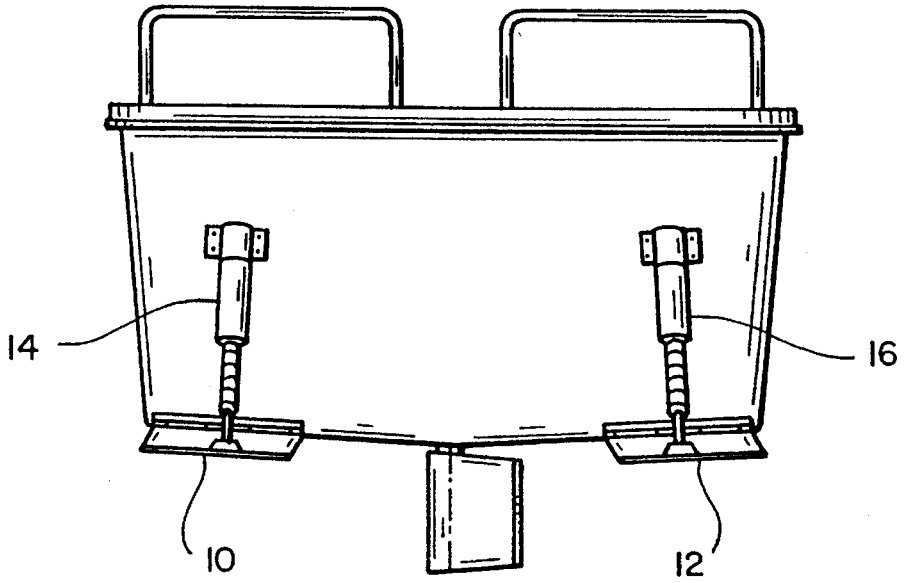
FIG 1 (PRIOR ART)
FIG. 1 is a stern view of a prior art boat which is mounted with a pair of adjustable trim tabs.
Figure 2:
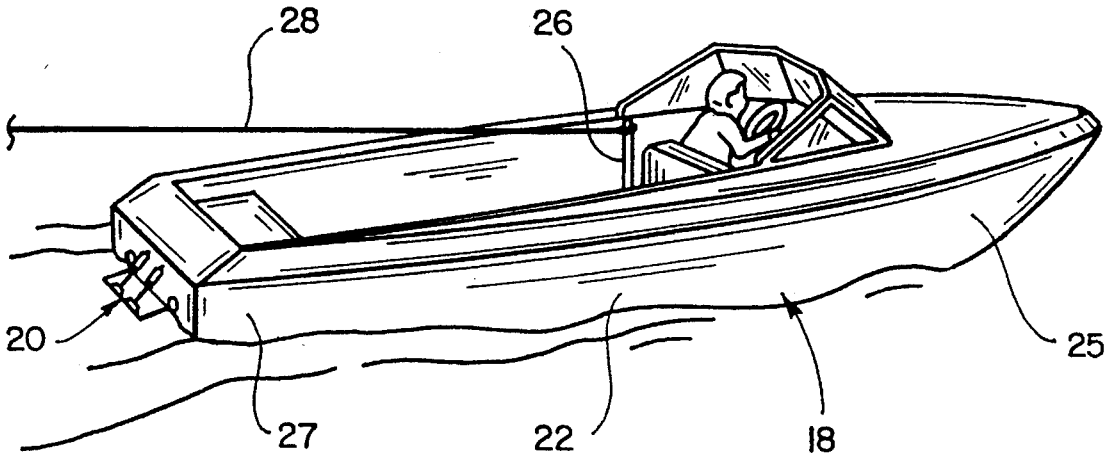
FIG. 2 is a perspective view illustrating a ski tow boat incorporating a wake control device in accordance with the present invention.

In the drawings, FIG. 2 illustrates generally at 18 a tournament type ski tow boat incorporating a wake control device 20 in accordance with a preferred embodiment of the invention. Boat 18 has a hull 22, best shown in FIG. 3, which extends longitudinally to a stern transom 24. The hull 22 of the tournament ski tow boat is characterized in having a hull bottom contour with a V-shaped cross section along bow 25 which smoothly merges into a flat or semi-flat bottom along stern 27. Semi-flat means a bottom with a shallow V-shape in which the sides of the hull bottom incline up and outwardly from horizontal at angles of up to only substantially 3°. An upright pylon 26 is mounted at about the middle of the hull for attaching an end of the ski tow rope 28.

Figure 3:
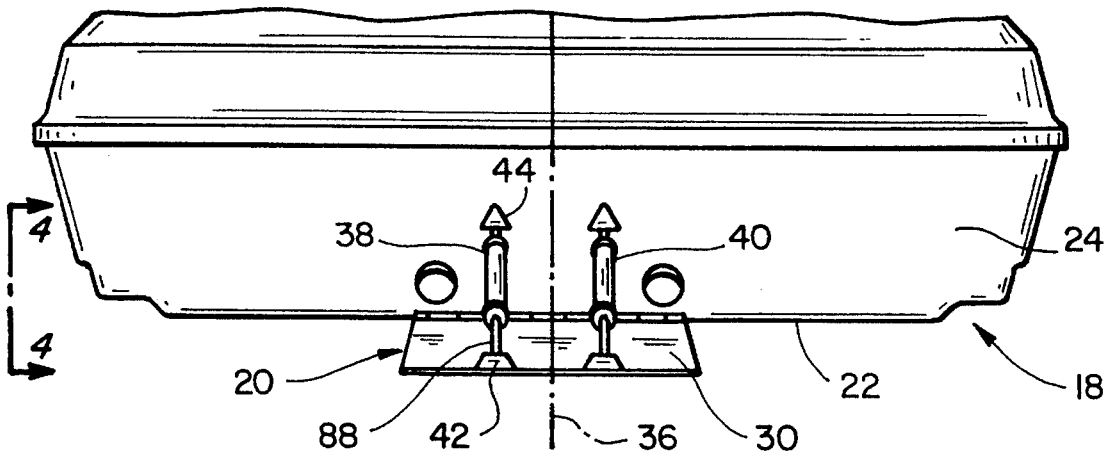
FIG. 3 is a stern view to an enlarged scale of the ski tow boat shown in FIG. 2.

Wake control device 20 is comprised of a single flat plate 30 having a forward end 32 and trailing end 33. The forward end is pivotally mounted by a hinge 34 to the lower end of the stern transom. The plate is positioned along the hull's longitudinal centerline which passes through the boat's vertical mid-plane 36 (FIG. 3). In the present embodiment, the plate is illustrated as rectangular with its major axis extending athwart the hull. In a typical configuration, the plate's length along its major axis can be 23", and the width of the plate from the forward end to its trailing end can be 10". The opposite corners of the trailing edge could be rounded for purposes of user safety. It is understood that the invention contemplates other configurations for the plate, such as square or oval. An optional swimstep, not shown, can be mounted from the stern above the control device to facilitate ingress and egress of the skier to and from the boat.

In the invention, the provision of a single wake control plate at the stern along the boat's centerline is specific for use with the flat bottom hull of a tournament-type ski tow boat. Such a plate would not be suitable for mounting on larger boats having V-bottom hulls, nor would it be adaptable for use for smaller inboard boats having stern drives or with boats powered by outboard motors because the location of the stern drives and outboard motors would interfere with the wake control plate.

Figure 4:
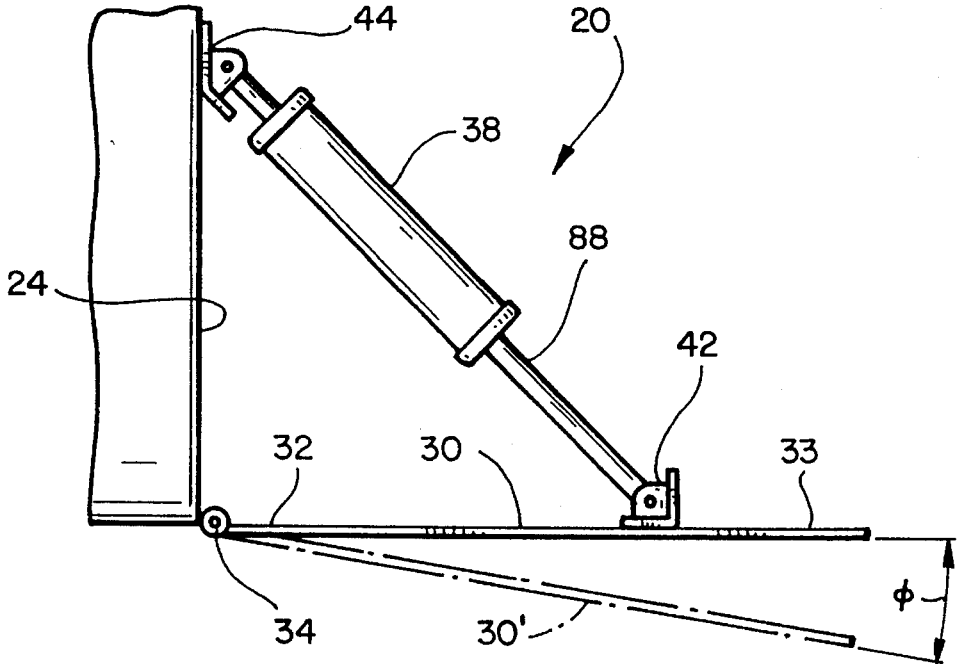
FIG. 4 is a fragmentary side view, to enlarged scale, of the stern taken along the line 4—4 of FIG. 3.
Figure 5:
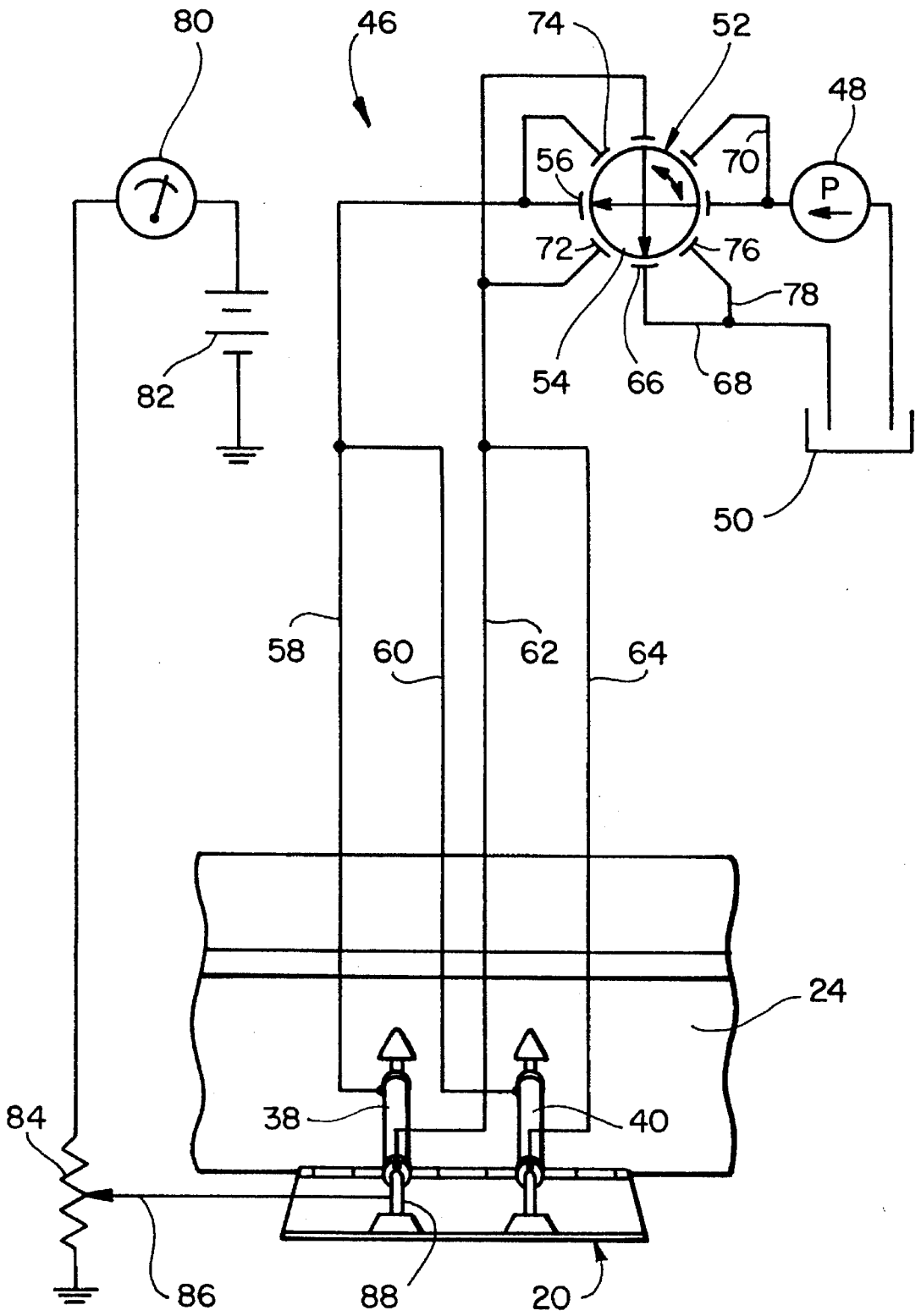
FIG. 5 is a schematic view illustrating the control arrangement for the wake control device shown in FIG. 3.

Control means is provided for pivoting plate 30 about the transverse axis of the hinge between a raised position, shown in solid line in FIG. 4, and a lowered position shown in broken lines at 30'. The control means includes a pair of actuators 38 and 40 which comprise hydraulic cylinders. The actuators have their rod ends mounted by pivot pins to brackets 42 secured on the top of the plate, and the head ends of the cylinders are mounted by pivot pins to brackets 44 which are secured to the stern transom. The actuators are extended and contracted by the control circuit 46 of FIG. 5 for moving trailing end 33 through the angle $\phi$ which defines the vertical stroke. It has been found that a vertical stroke in the range of only 1½" to 2" is sufficient to vary the wake from a small size to a relatively large size.

Control circuit 46 is comprised of an hydraulic pump 48 which directs fluid under pressure from reservoir 50 into a rotary position selector valve 52. The selector valve is comprised of a valve spool 54 which is rotated by means of a suitable control, not shown, located in the pilot's compartment of the boat. Rotation of the valve spool to the position shown in FIG. 5 directs pressurized fluid into outlet port 56 and through conduits 58 and 60 into the head ends of the hydraulic cylinders. Return fluid from the rod ends of the cylinders is directed through the conduit 62 and 64 back through the spool valve and out through port 66 into a conduit 68 to the reservoir. In this position of the valve spool, the actuators extend and pivot the plate's trailing end toward the lowered position. The plate trailing end can be stopped at a selected position along its vertical stroke by turning the valve stem to an intermediate position at which the outlet ports from the valve are closed. For moving the plate trailing end back to its raised position, the valve spool is turned clockwise to a position 45° from that shown in FIG. 5. This directs fluid from the pump through conduit 70 and out through port 72 which leads into conduits 62 and 64 to the rod ends of the cylinders. Return fluid is directed back through conduits 58 and 60 into port 74, then through the valve spool and out through port 76 and conduit 78 to the reservoir.

Visual indication of the instantaneous position of the plate trailing edge along its stroke is provided to the operator in the pilot's compartment by a gauge 80, which can be an ammeter. The gauge is connected in a circuit which comprises a power source, shown schematically as a battery 82, and a potentiometer 84. A wiper 86 of the potentiometer is mounted for movement with the rod 88 of actuator 38. As the rod extends or retracts and moves the wiper, the resistance of the potentiometer changes to vary the current through the circuit. The variable resistance of the potentiometer thereby changes the position of the indicator in the gauge for indicating plate position.

For operating with small wakes, control circuit 46 is operated to move control plate 20 down. With the plate extending rearwardly and downwardly, it projects into the water which moves in a stream under the hull. The upward reaction forces on the plate from the water stream raises the stern up so that the hull rides substantially flat across the water, producing a minimal wake. When it is desired to create larger wakes, the control circuit is operated to move the control plate up through its stroke toward the raised position. Stern thrust forces from the boat's propellers raise the bow out of the water so that the hull is at a high angle of attack, causing the stern to sit down into the water and effectively dig a trench in the water along the path of the boat to create the higher wakes. Appropriate control of valve spool 54 correspondingly controls the wakes to the size desired by the skier.

While the foregoing embodiments are at present considered to be preferred, it is understood that numerous variations and modifications may be made therein by those skilled in the art and it is intended to cover in the appended claims all such variations and modifications as followed within the true spirit and scope of the invention.

What is claimed is:

1. A wake-controllable tournament style inboard power boat for towing water skiers, the boat comprising a hull having a longitudinal axis extending between a bow and stern, the stern comprising a bottom having port and starboard sides which are joined together longitudinally and with each side extending with respect to horizontal at an angle in the range of 0° to no more than substantially 3°, said stern having a given lateral width; a wake control plate having a forward end and a trailing end, said plate having a width which is no greater than half said given lateral width of the stern; means for mounting the forward end of the plate on the stern for pivotal movement about a transverse axis with the plate being substantially centered on said longitudinal axis; and control means for pivoting the plate around the transverse axis so that the trailing end moves vertically between a raised position and a lowered position, said control means being operable to pivot the plate to selected positions between said raised and lowered positions to vary the extent to which the trailing end of the plate projects into water which moves in a stream relative to the hull as the boat moves forwardly whereby the size of the wake made in the water by the boat can be selectively controlled.

2. A wake control device as in claim 1 in which: the control means causes the trailing end to extend in a direction rearwardly and downwardly from the stern when the plate is pivoted to its lowered position.

3. A wake control device as in claim 2 in which: the control means causes the trailing end to project into the water below the hull when the plate is pivoted to its lowered position.

4. A wake control device as in claim 1 in which: said forward end of the plate is pivotally mounted at the lower end of the stern and the trailing end extends rearwardly from said lower end when the plate is in its raised position.

5. A method for controlling the wake made in water by a tournament style inboard power boat of the type having a hull with a stern comprising a bottom with port and starboard sides each of which extend with respect to horizontal at an angle in the range of 0° to no more than substantially 3°, the method comprising the steps of: moving the boat forward over the surface of water at a speed which causes the water to move rearwardly relative to the hull and trail away from the hull in streams which move along the port and starboard sides of the stern; positioning a plate at the stern substantially centered on a longitudinal axis of the hull; pivoting the plate about a transverse axis to move the trailing end of the plate up toward a raised position extending rearwardly of the stern to cause the hull to have a high angle of attack through the water and to cause the boat to create wakes of a given size, and pivoting the plate about the transverse axis to move the trailing end down toward a lowered position so that the trailing end extends rearwardly and downwardly of the stern into said streams of water to cause the hull to have an angle of attack less than said high angle of attack to reduce the size of the wakes created by the boat.

6. A method as in claim 5 and further comprising the steps of: holding the trailing end at a selected position between said raised and lowered positions to selectively control the size of the wakes.

7. A method as in claim 5 in which: the step of pivoting the plate includes moving the trailing end into the water below the hull when the trailing end is pivoted toward its lowered position.

* * * * *